US008196881B1

(12) United States Patent
Reinbold

(10) Patent No.: US 8,196,881 B1
(45) Date of Patent: Jun. 12, 2012

(54) COUNTERTOP CUT-OUT RETAINER AND METHOD OF USE THEREOF

(76) Inventor: Curt A. Reinbold, Frankenmuth, MI (US)

( * ) Notice: Subject to any disclaimer, the term of this patent is extended or adjusted under 35 U.S.C. 154(b) by 0 days.

(21) Appl. No.: 12/887,359

(22) Filed: Sep. 21, 2010

(51) Int. Cl.
*A47B 96/06* (2006.01)

(52) U.S. Cl. ..... 248/222.13; 269/289 R; 269/302.1

(58) Field of Classification Search ..... 248/205.11, 248/220.21, 220.22, 220.31, 222.13; 269/289 R, 269/302.11
See application file for complete search history.

(56) References Cited

U.S. PATENT DOCUMENTS

| | | | | |
|---|---|---|---|---|
| 2,885,691 | A | 5/1959 | Juergens | |
| 3,128,479 | A | 4/1964 | Juergens | |
| 3,973,295 | A | 8/1976 | Janke | |
| 4,102,374 | A | 7/1978 | Klein | |
| 4,318,537 | A * | 3/1982 | Dorman et al. | 269/302.1 |
| 4,958,888 | A | 9/1990 | Livnah | |
| 5,673,905 | A * | 10/1997 | Kiene | 269/238 |
| 6,262,582 | B1 * | 7/2001 | Barringer et al. | 324/756.01 |
| 6,793,190 | B2 | 9/2004 | White et al. | |
| 6,866,458 | B2 | 3/2005 | Farrell et al. | |
| 2009/0108719 | A1 * | 4/2009 | Lilly | 312/140.3 |
| 2010/0176560 | A1 * | 7/2010 | Burgess | 277/637 |
| 2011/0068240 | A1 * | 3/2011 | Yang et al. | 248/221.11 |

* cited by examiner

*Primary Examiner* — Ramon Ramirez
(74) *Attorney, Agent, or Firm* — Montgomery Patent & Design, LLC; Robert C. Montgomery; Joseph T. Yaksich

(57) ABSTRACT

A system designed to retain a countertop cut-out portion is herein disclosed. A plurality of retainers are intended to be installed at selected locations within initial saw cuts to prevent the cut-out portion from falling and causing damage or injury following the subsequent final saw cuts. The system is intended to be inserted into the saw cut in a longitudinal orientation and rotated into a transversal orientation thereby causing the foot to engage and support the bottom edge of the portion to be removed. Wedge shaped shims are used to compensate for countertop depth variations and to secure the location of the systems. Upon completion of the sawing process, the system allows the cut-out portion to be removed in a safe and controlled manner. The system is intended to accommodate all types of countertop thicknesses and materials, including laminate, granite, imitation or natural stone or marble, and the like.

13 Claims, 5 Drawing Sheets

COUNTERTOP CUT-OUT RETAINER AND METHOD OF USE THEREOF

RELATED APPLICATIONS

Not Applicable.

FIELD OF THE INVENTION

The present invention relates generally to the installation of flat working surfaces such as countertops, and in particular, to a system for retaining cutout portions of such a surface during installation to prevent damage to the surface.

BACKGROUND OF THE INVENTION

Many common kitchen fixtures and other similar items are located integrally within countertop surfaces. Such fixtures often include sinks, stoves, and the like. Due to the wide variety of such fixtures available, countertop surfaces are generally manufactured as bulk units which are then custom cut at the point of installation to allow for the specific fixtures which are to be placed within the surface.

Due to the unwieldy shape of many of these countertops, cut-out operations are often difficult to perform. It is generally necessary to support a cutout portion of the countertop during installation otherwise damage to the remaining countertop surface, the underlying cabinet, or flooring surface may result. Injuries to the workers can occur as well. This operation is difficult for a single user to manage. Either a second person is necessary to hold the cut-out from the bottom, or a large brace is built. Both processes generally result in increased cost, time, and labor necessary to perform these operations. Furthermore, recent additions to countertop building materials such as heavy stone, engineered stone and the like have only added to the problem.

Various attempts have been made to provide a retaining means for countertop fixtures. Examples of these attempts can be seen by reference to several U.S. patents. U.S. Pat. No. 2,885,691, issued in the name of Juergens, describes a sink retainer assembly which provides a means for securely retaining a sink in position during an installation operation.

U.S. Pat. No. 4,102,374, issued in the name of Klein, describes a jig and template apparatus for corner inserts which provides cutting guides and a pneumatic piston assembly for securing the workpiece and corresponding templates.

U.S. Pat. No. 6,793,190, issued in the name of White et al., describes a retainer clip designed for mounting sinks to countertops which includes a ratchet plate and a pawl allowing for press-in above-counter installation of the fixture.

While these devices fulfill their respective, particular objectives, each of these references suffer from one (1) or more of the aforementioned disadvantages. Many such devices are not adaptable to a wide variety of fixture installations. Also, many such devices are not suitable for retaining a cut-out portion of a countertop surface during a cutting operation. Furthermore, many such devices do not allow a user to make cuts to the surface while the device is in place. Accordingly, there exists a need for a countertop cut-out retainer without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to provide a system for a single user to prevent the unwanted falling of cut-out portions of a countertop during a cutting operation for safe removal of the piece after cutting. Thus, the object of the present invention is to solve the aforementioned disadvantages and provide for this need.

To achieve the above objectives, it is an object of the present invention to provide a means for preventing a cutout portion of countertop from falling away after completion of a peripheral sawing operation. The system comprises a plurality of retainers and a plurality of wedges.

Another object of the present invention is to provide a means for simultaneously installing a plurality of retainers and each wedge about a cut-out portion in order to provide secure retention of the cut-out.

Yet still another object of the present invention is to provide variable height adjustment to the system while maintaining a flat and parallel relationship between top and bottom surfaces of the wedge and a countertop surface. This is accomplished via relative sliding motion of the tapered surfaces of the wedge.

Yet still another object of the present invention is to provide a means for securely supporting the bottom portion of a cut-out section of a countertop via the retainers. Each retainer comprises a head, a stem, a foot, and a notch constructed of a strong durable material, where the head provides a means for the retainer to securely rest upon a top side of a wedge or countertop surface. The head is integrally connected to a foot portion via the stem, with the foot providing a flat resting surface for a bottom side of a cutout portion.

Yet still another object of the present invention is to allow a user to insert a retainer into a partially cut kerf in a countertop surface. Each retainer comprises a thickness and stem width small enough to insert through a partial cut in the surface in a parallel orientation.

Yet still another object of the present invention is to easily and securely engage a bottom surface of a cut-out portion via rotating the retainers by ninety degrees after insertion through a partial kerf in the surface. The rotating motion is facilitating by the thin square profile of the stem. This motion brings the foot and head into a perpendicular orientation with regards to the cut, allowing these portions to securely engage a bottom surface of the cut-out portion and a top surface of the countertop, respectively.

Yet still another object of the present invention is to simultaneously install a plurality of retainers and slide them along existing kerfs in order to achieve a desired configuration of retainers for securely supporting a cut-out.

Yet still another object of the present invention is to provide secure, tight engagement between the retainers and the cut-out portion via installation and adjustment of a wedge assembly at each retainer. Positioning and tightening of the wedge assemblies further tightens the foot and head against the cut-out portion and wedge assembly, respectively.

Yet still another object of the present invention is to provide a method of utilizing the device that provides a unique means of allowing a single user to provide a desired cut-out portion of a countertop with several partial kerfs, place a retainer through each cut, rotate the retainer to provide engagement with the countertop and cut-out portion respectively, move the retainers in a desired configuration, tighten each retainer against the surfaces via installation and adjustment of each wedge, finish the cutting operation while maintaining the position of the cut-out portion relative to the countertop, and safely remove each wedge, retainers, and cut-out portion after cutting is finished.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
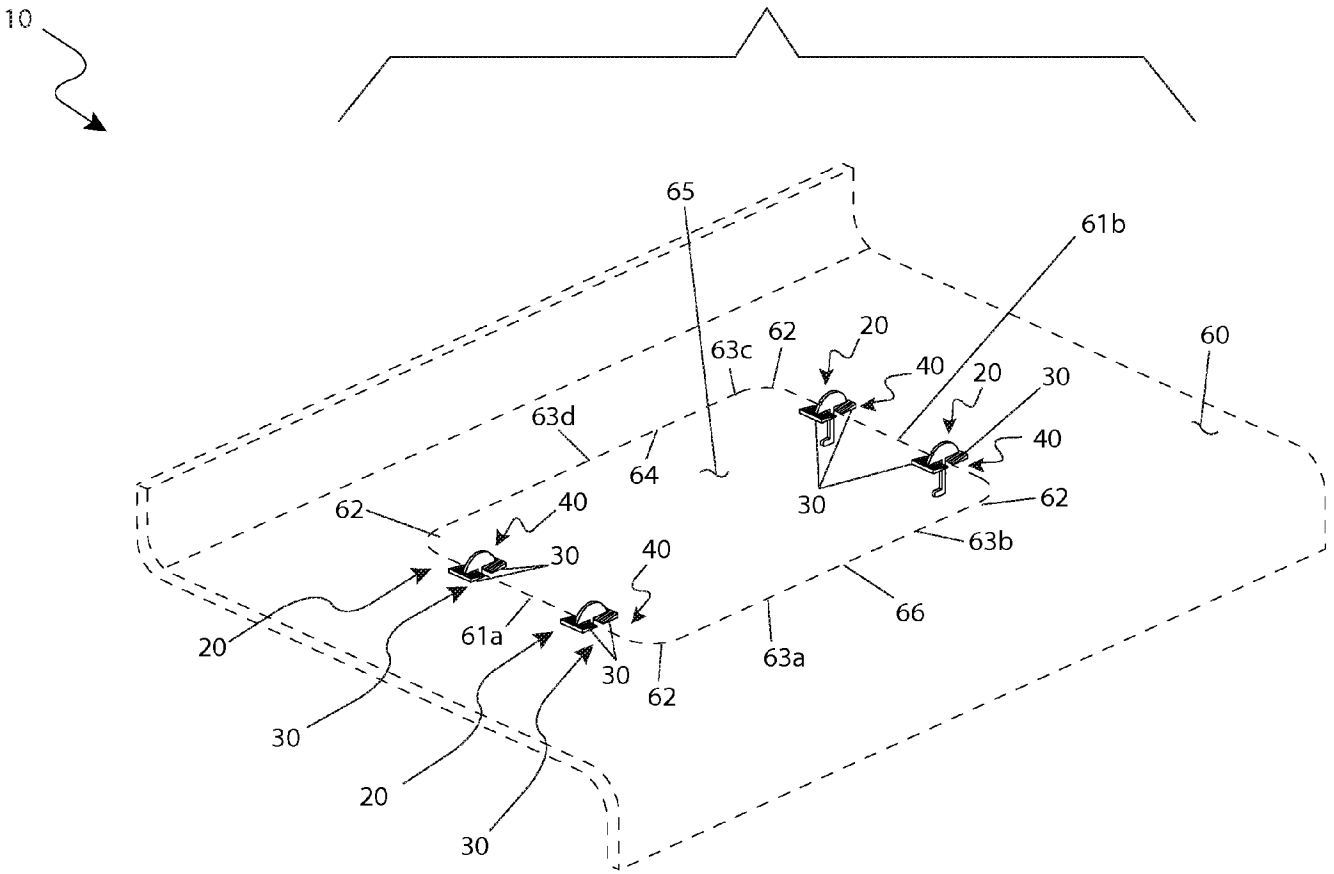
FIG. 1 is a perspective environmental view of a plurality of installed systems 10, according to a preferred embodiment of the present invention.

10 countertop cut-out retainer system
11 head
12 stem
13 foot
14 notch
17 dimension "A"
20 retainer
30 wedge
31 wedge groove
60 countertop
61*a* left kerf
61*b* right kerf
62 corner aperture
63*a* first front kerf
63*b* second front kerf
63*c* first rear kerf
63*d* second rear kerf
64 rear uncut section
65 cut-out portion
66 front uncut section

DETAILED DESCRIPTION OF THE PREFERRED EMBODIMENT

Figure 2A:
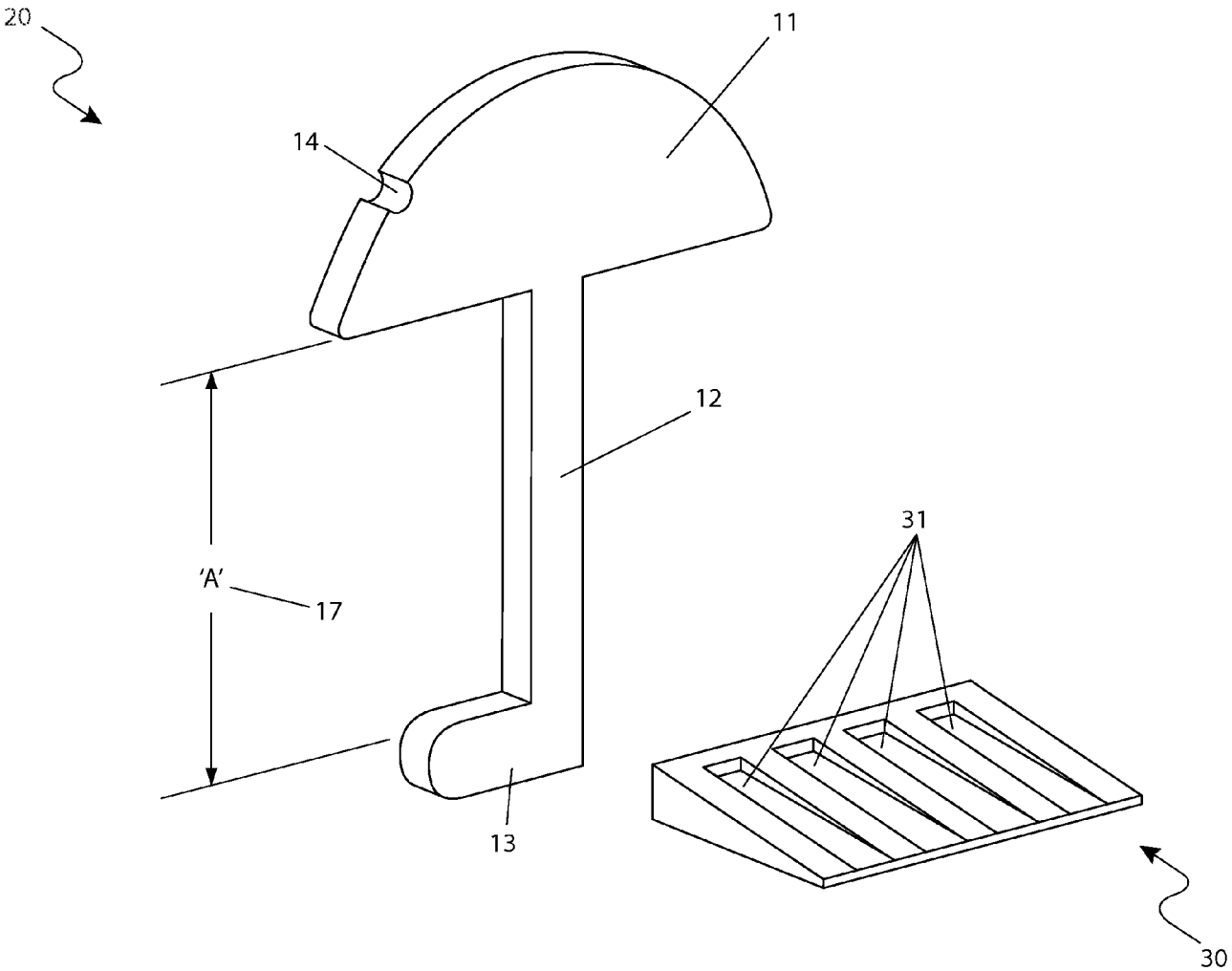
FIG. 2*a* is an enlarged perspective view of the system 10, according to the preferred embodiment of the present invention.
Figure 2B:
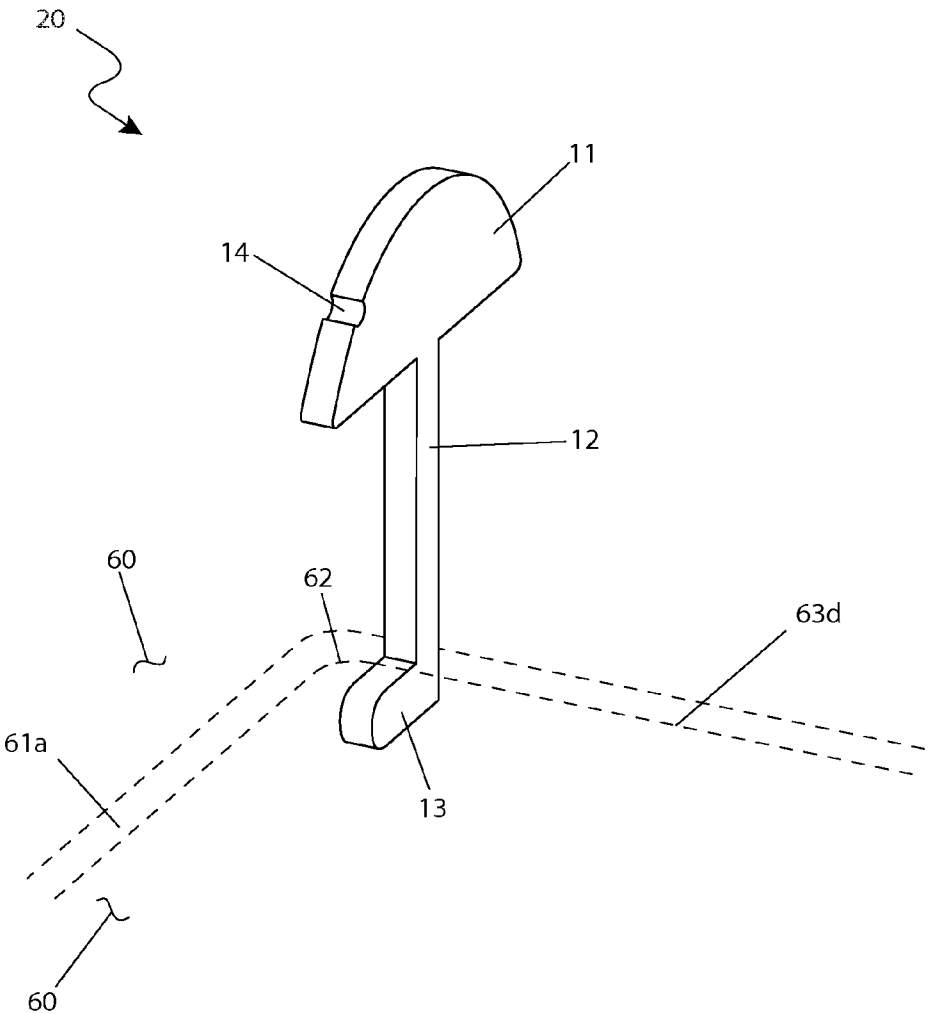
FIG. 2*b* is an enlarged perspective view of a retainer 20 in a state of being inserted, according to the preferred embodiment of the present invention.
Figure 2C:
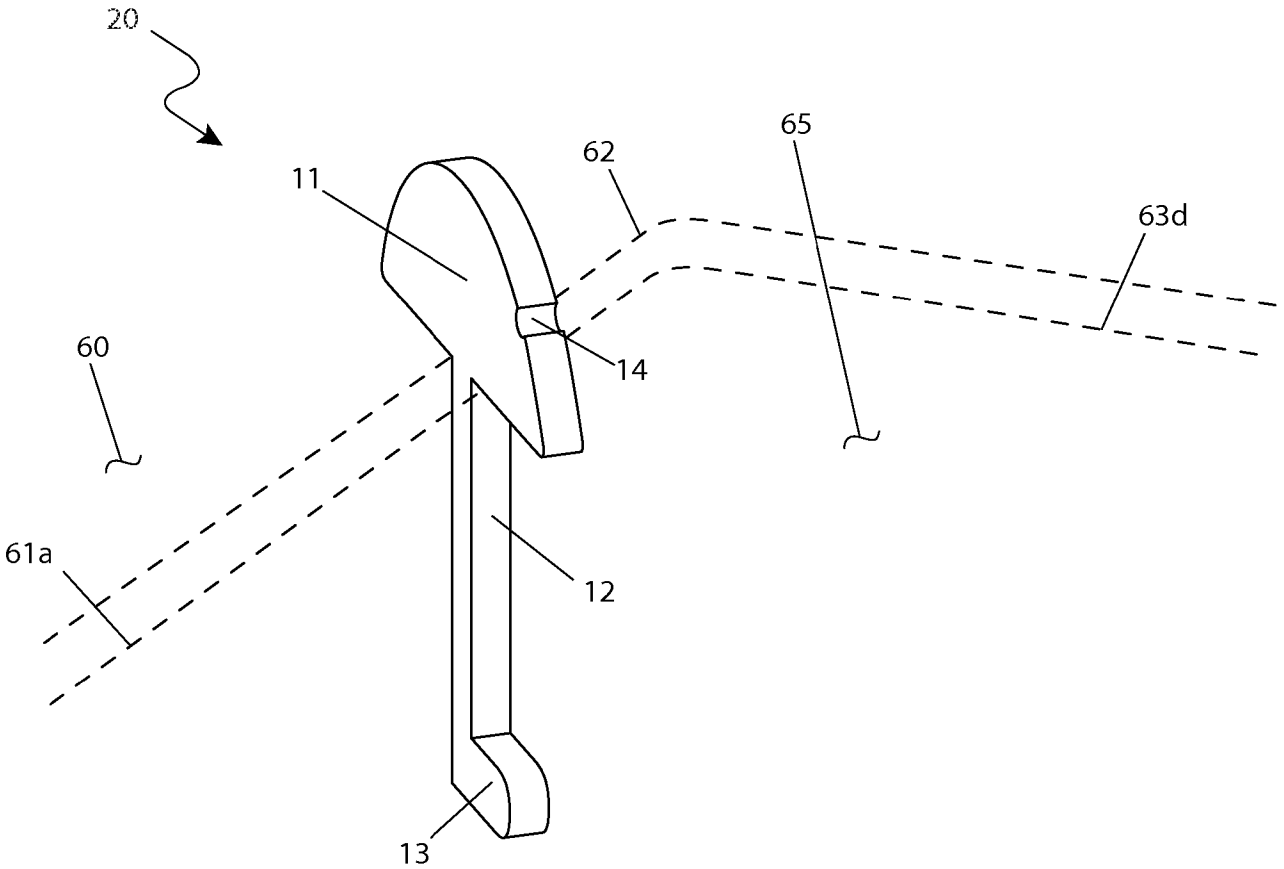
FIG. 2*c* is an enlarged perspective view of the retainer 20 in a state of being moved to a selected location and partially rotated, according to the preferred embodiment of the present invention; and, FIG. 2*d* is an enlarged perspective view of the system 10 in a state of having been installed at the selected location, according to the preferred embodiment of the present invention.
Figure 2D:
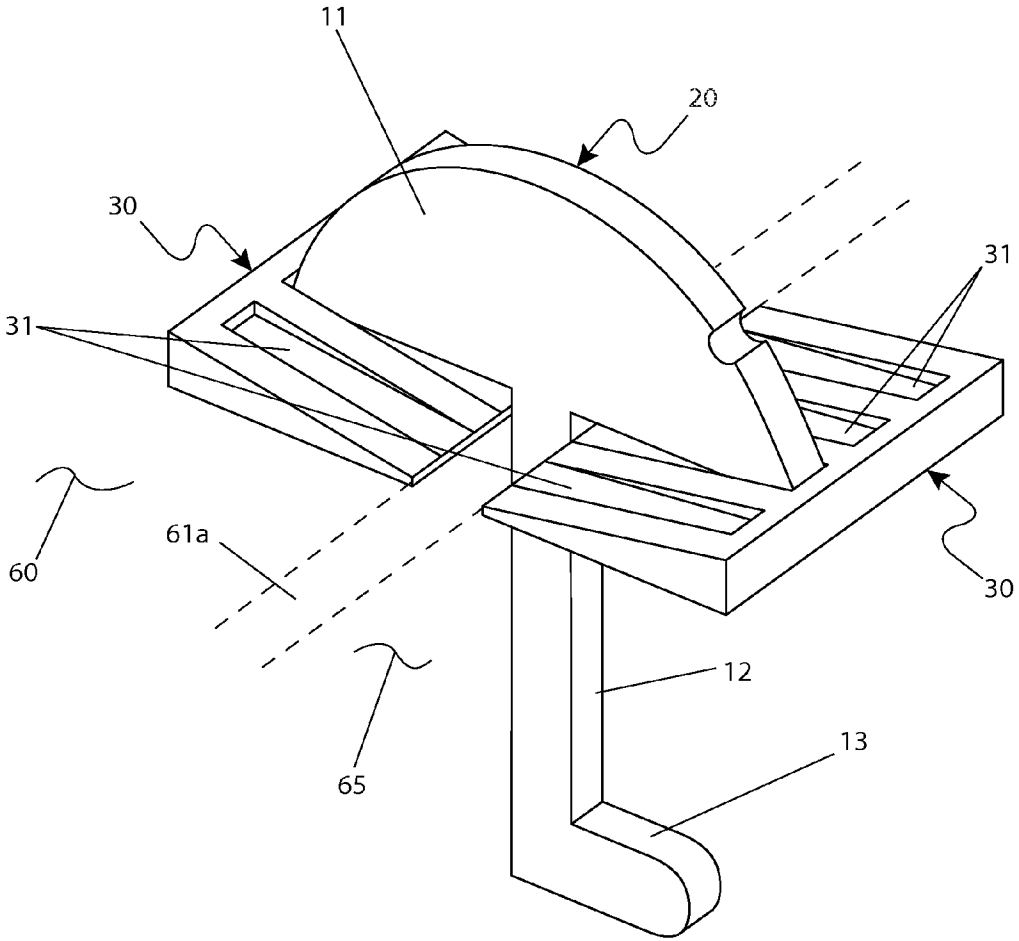

The best mode for carrying out the invention is presented in terms of its preferred embodiment, herein depicted within FIGS. 1 through 2*d*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a countertop cut-out retainer system (herein described as the "system") 10, which provides a means for preventing a cut-out portion 65 from falling away from the underside of the countertop 60 after completion of a peripheral sawing operation.

Referring now to FIG. 1, a perspective environmental view of a plurality of installed systems 10 as installed onto a countertop 60, according to the preferred embodiment of the present invention, is disclosed. A first pair of devices 10 is depicted as installed within a left kerf 61*a* and a second pair of devices 10 is depicted as installed within right kerf 61*b*.

Referring now to FIG. 2*a*, an enlarged perspective view of the system 10, according to the preferred embodiment of the present invention, is disclosed. The head 11, the stem 12, and the foot 13 of the retainer 20 are integral members of a configuration envisioned to be a single piece stamping made from a strip material of stainless or mild steel, or a plastic molding. The material is envisioned to comprise a minimum thickness which will provide the required rigidity, wherein the stem 12 comprises a width which is equal to the material thickness in order to provide a square cross section of sufficient strength. The retainer 20 is to be introduced in different models which provide corresponding distances between the head 11 and the foot 13 portions as indicated by dimension 'A' 17. Dimension 'A' 17 is to correspond to particular standard countertop thicknesses such as, but not limited to: one-half (½) inch, three-quarter (¾) inch, one-and-one-quarter (1¼) inch, and the like. The system 10 comprises a plurality of wedges 30 to be utilized to compensate for variations in countertop material thickness. Said wedges 30 are designed to be used in opposing pairs under the head portion 11 of the retainers 20 as needed, where sliding the tapered surfaces of each wedge 30 under the head 11, provides an infinite variation of height adjustment. The wedges 30 are envisioned to be made of plastic or wood, or any other material which will not mar or otherwise damage the upper surface portion of the countertop 60. Said wedges 30 further comprise a plurality of sloped grooves 31 providing vertical stability to the retainer 20 during use. Commercially available tapered shims made of wood can be substituted for the envisioned specialized wedges 30.

Referring now to FIG. 2*b*, an enlarged perspective view of a retainer 20, according to the preferred embodiment of the present invention, is disclosed. The retainer 20 is depicted in the process of being inserted through a corner aperture 62 with the foot 13 oriented longitudinally in the direction of the first left kerf 61*a*. The corner aperture 62 is drilled to provide a clean cutout corner and to facilitate the subsequent cutting of the kerf 61*a* and 63*d*. The width of the stem 12 of the retainer 20 is intended to be similar to the material thickness thereby producing a square cross-section of the stem 12. The intent of the square cross-section is to minimize the space required to rotate the stem 12 within the width of the first left kerf 61*a* and the first right kerf 61*b*. The diameter of each corner apertures 62 is intended to provide the clearance needed to allow the foot 13 to be inserted through the countertop 60.

Referring now to FIG. 2*c*, an enlarged perspective view of the retainer 20, according to the preferred embodiment of the present invention, is disclosed. The retainer 20 is depicted in a state of being moved to a selected location along the kerf

61*a* while being partially rotated toward a transversal orientation wherein the foot 13 supports the underside edge of the cut-out portion 65.

Referring now to FIG. 2*d*, an enlarged perspective view of the system 10, according to the preferred embodiment of the present invention, is disclosed. The retainer 20 is depicted as installed at the selected location and rotated into the transversal orientation whereby the foot 13 is enabled to support the underside edge of the cut-out portion 65. Installing and adjusting of the pairs of corresponding wedges 30 secures the positioning of the retainer 20 and tightens the foot 13 against the underside edge of the cut-out portion 65, thus ensuring the retention of the cut-out portion 65 at the end of the cutting process. Since the orientation of the notch 14 is similar to the orientation of the foot 13, the supporting status of the foot 13 is ensured when the notch 14 is pointing toward the cut-out portion 65.

It is envisioned that other styles and configurations of the present invention can be easily incorporated into the teachings of the present invention, and only one particular configuration shall be shown and described for purposes of clarity and disclosure and not by way of limitation of scope. Alternate embodiments are envisioned to comprise an appropriate variety of spacing dimensions between the underside portion of the head 11 and the topside portion of the foot 13 to allow the retainer 20 to accommodate various countertop thicknesses, designs and material, such as, but not limited to: FORMICA® laminated onto fiberboard or plywood, granite, marble, imitation marble, or ceramic.

The preferred embodiment of the present invention can be utilized by the common user in a simple and effortless manner with little or no training. After initial purchase or acquisition of the retainer 20, it would be installed as indicated in FIG. 1.

The method of installing and utilizing the system 10 may be achieved by performing the following steps: marking an suitable square or rectangular outline of the cut-out portion 65*e* onto the top surface portion of the countertop 60; selecting an appropriate diameter for the corner apertures 62; locating the center of each corner aperture 62 in a manner wherein the circular perimeter of each corner aperture 62 is tangent to both corresponding lines forming the outlined square corners; center punching the center location of each corner aperture 62; drilling each corner aperture 62; sawing the width of the first left kerf 61*a* by starting from a selected left side corner apertures 62 and ending at the opposite corresponding corner aperture 62; sawing the width of the first right kerf 61*b* by starting from a selected right side corner apertures 62 and ending at the opposite corresponding corner aperture 62; sawing the first rear kerf 63*c* starting from the right rear corner aperture 62 and ending at a rear uncut section 64; sawing the second rear kerf 63*d* starting from the left rear corner aperture 62 and ending at the opposite end of the rear uncut section 64; sawing the first front kerf 63*a* starting from the left front corner aperture 62 and ending at a front uncut section 66; sawing the second front kerf 63*b* starting from the right front corner aperture 62 and ending at the opposite end of the front uncut section 66; passing the foot 13 of each retainer 20 through one (1) of the corner apertures 62; sliding each retainer 20 thereto a selected location along the first left kerf 61*a* and the first right kerf 61*b*; rotating each retainer 20 to the orientation wherein the notch 14 points toward the cut-out portion 65; installing a wedge 30 under each side of the head until the retainer 20 is snug within the left 61*a* and right 61*b* kerfs; finishing the cutting operation by sawing through the uncut rear and front sections 64 and 66; lifting the cut-out portion 65 either by grasping the head 11 of a pair of diagonally opposite retainers 20 or by means of an appropriately sized suction cup fastened onto the center of the cut-out portion 65; and removing, cleaning and storing the plurality of retainers 20.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A countertop cut-out retainer system for preventing a countertop cut-out portion from falling away from an underside of a countertop after completion of a peripheral sawing operation, said countertop cutout retainer system comprising:

a plurality of retainers, each further comprising:

a head adapted to be located above said countertop cut-out portion;

a stem having a square cross-section extending downwardly from said head and terminating subjacent to said countertop cut-out portion;

a foot attached to said stem; and, a notch formed in said head;

wherein said head, said stem and said foot form an integral single piece; and, wherein said notch and said foot are orientated in a same direction; and, a plurality of wedges;

wherein said plurality of wedges are tightened against said retainers respectively and thereby adapt said retainers to support an underside edge of the countertop cut-out portion after completion of the peripheral sawing operation.

2. The countertop cut-out retainer system of claim 1, wherein said stem is adapted to rotate within a width of kerfs on the countertop after completion of the peripheral sawing operation, wherein a width of said stem is adapted to have a thickness equal to a thickness of said countertop.

3. The countertop cut-out retainer system of claim 2, wherein said thickness corresponds to standard countertop thicknesses of one-half (½) inch, three-quarter (¾) inch, and one-and-one-quarter (1¼) inch.

4. The countertop cut-out retainer system of claim 2, wherein each of said plurality of wedges comprises:

a wedge body having a top and a bottom surface, said top surface being tapered relative to said bottom surface; and, a plurality of wedge grooves sloping downward and disposed on said tapered top surface, thereby providing vertical stability to each of said retainers during use.

5. The countertop cut-out retainer system of claim 4, wherein said tapered top surfaces of a pair of said plurality of wedges slidably engage said stem such that said bottom surfaces of said pair of said plurality of wedges maintain a constantly flat and parallel relationship relative to each other respectively.

6. The countertop cut-out retainer system of claim 5, wherein said foot is adapted to support the underside edge of the countertop cut-out portion, wherein said pair of said plurality of wedges are tightened to said foot.

7. A countertop cut-out retainer system for preventing a countertop cut-out portion from falling away from an underside of a countertop after completion of a peripheral sawing operation, said countertop cut-out retainer system comprising:

a plurality of unitary retainers, each further comprising:

a head adapted to be located above said countertop cut-out portion;

a stem having a square cross-section extending downwardly from said head and terminating subjacent to said countertop cut-out portion;

a foot attached to said stem; and, a notch formed in said head;

wherein said head, said stem and said foot form an integral single piece; and, wherein said notch and said foot are orientated in a same direction;

a plurality of wedges; and, wherein said plurality of wedges are tightened against said retainers respectively and thereby adapt said retainers to support an underside edge of the countertop cut-out portion after completion of the peripheral sawing operation.

8. The countertop cut-out retainer system of claim 7, wherein said stem is adapted to rotate within a width of kerfs on the countertop after completion of the peripheral sawing operation, wherein a width of said stem is adapted to have a thickness equal to a thickness of said countertop.

9. The countertop cut-out retainer system of claim 8, wherein said thickness corresponds to standard countertop thicknesses of one-half (½) inch, three-quarter (¾) inch, and one-and-one-quarter (1¼) inch.

10. The countertop cut-out retainer system of claim 8, wherein each of said plurality of wedges comprises:

a wedge body having a top and a bottom surface, said top surface being tapered relative to said bottom surface; and, a plurality of wedge grooves sloping downward and disposed on said tapered top surface, thereby providing vertical stability to each of said retainers during use.

11. The countertop cut-out retainer system of claim 10, wherein said tapered top surfaces of a pair of said plurality of wedges slidably engage said stem such that said bottom surfaces of said pair of said plurality of wedges maintain a constantly flat and parallel relationship relative to each other respectively.

12. The countertop cut-out retainer system of claim 11, wherein said foot is adapted to support the underside edge of the countertop cut-out portion, wherein said first and second wedges are tightened to said foot.

13. A method that utilizes a countertop cut-out retainer system for preventing a countertop cut-out portion from falling away from an underside of a countertop after completion of a peripheral sawing operation, said method comprising the steps of:

providing a plurality of unitary retainers, each further comprising:

a head adapted to be located above said countertop cut-out portion;

a stem having a square cross-section extending downwardly from said head and terminating subjacent to said countertop cut-out portion;

a foot attached to said stem; and, a notch formed in said head;

wherein said head, said stem and said foot form an integral single piece; and, wherein said notch and said foot are orientated in a same direction;

providing a plurality of wedges; and, said retainers supporting an underside edge of the countertop cut-out portion after completion of the peripheral sawing operation by tightening said plurality of wedges against said retainers respectively.

* * * * *